US006251556B1

(12) United States Patent
Yoshida et al.

(10) Patent No.: US 6,251,556 B1
(45) Date of Patent: Jun. 26, 2001

(54) TONER FOR DEVELOPING ELECTROSTATIC IMAGES

(75) Inventors: Eiichi Yoshida, Sano; Manabu Ogawa, Hiratsuka; Hiroshi Masuda, Sano; Hiroshi Serizawa, Kazo, all of (JP)

(73) Assignee: Fuji Xerox Co Ltd, Tokyo (JP)

( * ) Notice: Subject to any disclaimer, the term of this patent is extended or adjusted under 35 U.S.C. 154(b) by 0 days.

(21) Appl. No.: 09/445,754

(22) PCT Filed: Apr. 10, 1998

(86) PCT No.: PCT/JP98/01651

§ 371 Date: Dec. 10, 1999

§ 102(e) Date: Dec. 10, 1999

(87) PCT Pub. No.: WO99/53382

PCT Pub. Date: Oct. 21, 1999

(51) Int. Cl.[7] ..... G03G 9/00

(52) U.S. Cl. ..... 430/109; 430/111; 430/137

(58) Field of Search ..... 430/109, 111, 430/137

(56) References Cited

U.S. PATENT DOCUMENTS 5,344,738 9/1994 Kmiecik-Lawrynowicz ..... 430/137

FOREIGN PATENT DOCUMENTS 293657 4/1990 (JP) .
2259771 10/1990 (JP) .
7146585 6/1995 (JP) .

*Primary Examiner*—Mark Chapman

(57) ABSTRACT

Provided is a toner used for developing an electrostatic image using as a binder resin, a low molecular weight polymer having less odor, which is obtained by emulsion-polymerizing a radical-polymerizable unsaturated monomer at a temperature of 115° C. or higher in the presence or absence of a chain transfer agent.

30 Claims, No Drawings

TONER FOR DEVELOPING ELECTROSTATIC IMAGES

CROSS-REFERENCE TO RELATED APPLICATIONS

This application is the entry into the National Phase, under 35 USC §§363 and 371, based on International Application PCT/JP98/01651, Apr. 10, 1998.

1. Technical Field

The present invention relates to a toner used for developing an electrostatic image in electrophotography, electrostatic recording and electrostatic printing.

2. Background Art

A toner for developing an electrostatic image is usually produced by blending a colorant with a binder resin produced by various polymerization methods such as solution polymerization, bulk polymerization, suspension polymerization and emulsion polymerization and further blending suitably with an electrostatic charge-controlling agent, magnetic powder and the like, kneading them under heating and then pulverizing and classifying.

Polymers having a relatively small molecular weight are excellent as a binder resin in characteristics such as a heat-melting property, an adhesive property to various materials, a penetrability and the like and fulfill a large role for fixing a developed toner image on a transfer material such as paper, and therefore a lot of low molecular weight polymers are used as a binder resin alone or in combination with high molecular weight polymers.

When a low molecular weight polymer used as a binder resin is produced by emulsion polymerization, the emulsion polymerization has so far been carried out usually in the presence of a chain transfer agent in order to control the molecular weight of the resulting polymer to a low level. In general, aliphatic mercaptans and halogenated hydrocarbon base chain transfer agents are industrially used as the chain transfer agent.

However, a polymer dispersion obtained in the presence of mercaptans has an undesired specific odor even if the residual mercaptan content is small. Further, when halogenated organic compounds (for example, carbon tetrachloride, bromoform, bromotrichloromethane and the like) are used as chain transfer agents, the chain transfer agents have a relatively high residual content in the polymer dispersions.

Accordingly, when the polymer dispersions thus produced are used as a binder resin for a toner, the problems of unpleasant odor produced in heating and fixing and air pollution are brought about. Further, involved are the problems that since a chain transfer agent is bonded to the end of a polymer molecule, different characteristics from electrostatic characteristics which are intrinsic to the resin are revealed and that a change in the electrostatic characteristics with the passage of time due to the surrounding environment is caused.

The present inventors have found this time that when a radical-polymerizable unsaturated monomer is emulsion-polymerized under a higher polymerization temperature condition than a polymerization temperature usually used for emulsion polymerization, a polymer having a low molecular weight can readily be produced in the absence of a chain transfer agent or in the presence of, if present, a very small amount thereof and that a toner which causes no such problems as described above can be obtained by using the polymer produced in the manner described above as a binder resin.

In addition thereto, they have found that the emulsion polymer of a low molecular weight thus obtained can easily be turned into a toner by a coagulation method and this can provide a toner which has a small particle diameter and a narrow particle size distribution and which is excellent in a homogeneous dispersibility of a colorant without requiring pulverizing and classifying steps, and they have come to complete the present invention.

DISCLOSURE OF THE INVENTION

Thus, the present invention provides a toner for developing an electrostatic image comprising a binder resin and a colorant, wherein the above binder resin comprises a low molecular weight polymer which is obtained by emulsion-polymerizing a radical-poly-merizable unsaturated monomer in the presence or absence of a chain transfer agent and in which a weight average molecular weight is 2,000 to 100,000 and falls in a range shown by the following equation (1):

$$3 \leqq \log Mw < 1.5 - 1.18 \times \log(S + 0.001) \quad (1)$$

wherein Mw represents the weight average molecular weight of the polymer, and S represents an equivalent number of a polyatomic radical part of the chain transfer agent bonded to the end of the polymer chain per 100 g of the polymer.

The toner and the production process thereof according to the present invention shall be explained below in further details.

BEST MODE FOR CARRYING OUT THE INVENTION

The low molecular weight polymer (hereinafter referred to as the low molecular weight polymer of the present invention) used as a binder resin in the present invention is produced by emulsion polymerization in the absence of a chain transfer agent or the presence of a small amount, if used, of the chain transfer agent, and it is characterized by having a low molecular weight and a small content of chain transfer agent fragments introduced into the polymer by emulsion polymerization as compared with those of polymers produced by conventional emulsion polymerization methods.

That is, the low molecular weight polymer of the present invention has a weight average molecular weight and a content of a polyatomic radical part of the chain transfer agent falling in a range in which a relation shown by the following inequality is set up between the weight average molecular weight (Mw) and an equivalent number (S; when the chain transfer agent is not used in emulsion polymerization, S=0) per 100 g of the polymer, of a polyatomic radical part (hereinafter referred to as a chain transfer agent fragment) of the remaining chain transfer agent bonded to the end of the polymer chain as a result of emulsion polymerization:

$$3 \leqq \log Mw > 1.50 - 1.18 \times \log(S + 0.001) \quad (1)$$

preferably $$3.18 \leqq \log Mw > 1.24 - 1.18 \times \log(S + 0.001) \quad (1\text{-}1)$$

and more preferably $$3.3 \leqq \log Mw > 1.06 - 1.18 \times \log(S + 0.001) \quad (1\text{-}2)$$

The chain transfer agent is split at a part where it is most easily cleaved in a chain transfer reaction and is turned into a monoatomic radical and a polyatomic radical which is composed of plural atoms, or two polyatomic radicals, wherein one of them is bonded to a polymer radical to terminate a chain propagation reaction, and the other becomes a starting point for a new chain propagation reaction to be bonded to a newly formed polymer. "S" used in the inequality described above is an equivalent number per 100 g of the polymer, of ⌈a polyatomic radical⌋ bonded to the polymer as a result of such reaction. In general, it falls preferably in a range of 0 to 0.05, particularly 0 to 0.015 and above all, 0 to 0.005.

For example, trichloromethane ($CHCl_3$) is cleaved at a part of C—H in emulsion polymerization into a monoatomic radical (H.) and a polyatomic radical ($CCl_3$.). When emulsion polymerization is carried out using as a chain transfer agent, mercaptans ($RCH_2SH$) or dimercaptans ($RCH_2S$—$SCH_2R'$), bromotrichloromethane ($CCl_3Br$) or carbon tetrachloride ($CCl_4$), or dichlorodibromomethane ($CCl_2Br_2$), polyatomic radical parts (chain transfer agent fragments) introduced into the chain terminals of the resulting polymer are ⌈$RCH_2S$.⌋, ⌈$CCl_3$.⌋ and ⌈$CCl_2Br$.⌋ respectively.

The amount of the chain transfer agent fragments bonded to the chain terminals of the low molecular weight polymer of the present invention can be determined in the following manner.

First, a polymer dispersion is left standing at −20° C. through one night to be frozen and then molten at a room temperature. Further, the polymer is separated by means of an ultra-centrifugal separator. The separated polymer is dissolved or swollen in a good solvent such as toluene and then precipitated again in a poor solvent such as methanol or water and washed. In this case, it is to be confirmed that the polymer is not contained in the poor solvent.

The number of chain transfer agent fragments in the resulting polymer is determined by elemental analysis such as ion chromatography according to a combustion method or ICP (high frequency plasma emission analysis) or NMR (nuclear magnetic resonance analysis).

The low molecular weight polymer of the present invention having a weight average molecular weight and a content of chain transfer agent fragments satisfying the inequality described above is of a low molecular weight and has a small odor originating in the chain transfer agent, so that it can advantageously be used as a binder resin for a toner.

The low molecular weight polymer of the present invention has preferably a weight average molecular weight Mw falling in a range of 2,000 to 100,000, a number average molecular weight Mn falling in a range of 1,000 to 35,000 and a molecular weight (molecular weight peak) Mp which shows a maximum value in a gel permeation chromatography (GPC) chart falling in a range of 2,000 to 80,000, more preferably a weight average molecular weight Mw falling in a range of 3,000 to 70,000, a number average molecular weight Mn falling in a range of 2,000 to 30,000 and a molecular weight peak Mp falling in a range of 2,500 to 50,000, and particularly preferably a weight average molecular weight Mw falling in a range of 4,000 to 50,000, a number average molecular weight Mn falling in a range of 2,500 to 25,000 and a molecular weight peak Mp falling in a range of 3,500 to 40,000.

In the present invention, the weight average molecular weight Mw, the number average molecular weight Mn and the molecular weight peak Mp can be determined by the following method.

First, 50 ml of the polymer dispersion is put in a beaker of 100 ml, and about 10 ml of about 1N diluted sulfuric acid is dropwise added while stirring to precipitate the polymer or separate and precipitate it by means of an ultra-centrifugal separator. The polymer thus precipitated is filtered off and washed. Then, moisture on the surface is removed with a filter paper, and about 0.2 g thereof is weighed out and dissolved in about 50 ml of tetrahydrofuran (THF). Then, a solid content concentration of the resulting THF solution of the polymer is measured according to JIS K 6839. THF is further added to this solution to adjust the solid content to 0.2% by weight, and this is used as a sample to carry out gel permeation chromatography (GPC) analysis. A high speed liquid chromatography apparatus ⌈HLC-8020⌋ (manufactured by Toso Co., Ltd.) is used for a measuring instrument, and the molecular weight is based on a polystyrene-converted value.

The low molecular weight polymer of the present invention includes, for example, polymers capable of being synthesized by radical polymerization, such as styrene base resins, (meth)acryl base resins, fatty acid vinyl ester base resins, alkyl vinyl ether base resins and halogenated vinyl base resins. In particular, the styrene base resins and the (meth)acrylic base resins are preferred because various physical properties of the polymers are excellent.

The low molecular weight polymer of the present invention can have a glass transition temperature (Tg) falling in a range of usually 0 to 90° C., preferably 30 to 70° C. and more preferably 50 to 65° C. Further, the low molecular weight polymer of the present invention has preferably a gel content falling in a range of usually 0 to 40% by weight, particularly 0 to 10% by weight and further particularly 0 to 5% by weight.

In the present specification, the ⌈gel content⌋ of the polymer is a value calculated according to the following equation:

$$\text{gel content } (\%) = (W_1 - W_2)/W_1 \times 100$$

wherein 0.5 to 1.0 g of the polymer from which moisture is removed by the same method as in measuring the molecular weight described above is weighed ($W_1$) and put in a cylindrical filter paper (No. 86R manufactured by Toyo Filter paper Co., Ltd.); the filter paper is loaded in a Soxhlet's extractor to subject the polymer to extraction in 100 to 200 ml of tetrahydrofuran used as a solvent for 6 hours; and a residue obtained after removing the solvent from the extract is weighed ($W_2$).

The low molecular weight polymer of the present invention can be produced by emulsion-polymerizing a radical-polymerizable unsaturated monomer at a temperature of 115° C. or higher in the presence or absence of a chain transfer agent (hereinafter referred to as the emulsion polymerization according to the present invention).

The radical-polymerizable unsaturated monomers capable of being emulsion-polymerized shall not specifically be restricted as long as they are usually used for emulsion polymerization. The following ones can be given as the examples thereof, and these monomers can be used alone or in combination of two or more kinds thereof.

Styrene base monomers: included are, for example, styrene, o-methylstyrene, m-methylstyrene, p-methylstyrene, α-methylstyrene, α-methylstyrene dimer (2,4-diphenyl-4-methyl-1-pentene), p-ethylstyrene, 2,4-dimethylstyrene, p-n-butylstyrene, p-t-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene and p-chloromethylstyrene. Styrene is particularly preferred.

(Meth)acrylate base monomers: included are, for example, methyl acrylate, ethyl acrylate, n-butyl acrylate, i-butyl acrylate, propyl acrylate, n-octyl acrylate, decyl acrylate, lauryl acrylate, 2-ethylhexyl acrylate, stearyl acrylate, 2-chloroethtyl acrylate, methyl α-chloroacrylate, methyl methacrylate, ethyl methacrylate, propyl methacrylate, n-butyl methacrylate, i-butyl methacrylate, n-octyl methacrylate, decyl methacrylate, lauryl methacrylate, 2-ethylhexyl methacrylate and stearyl methacrylate. Among them, (meth)acrylates of $C_1$ to $C_{12}$, preferably $C_2$ to $C_8$ aliphatic alcohols can be used alone or in combination of two or more kinds thereof.

Aliphatic acid vinyl ester base monomers: for example, $C_1$ to $C_{12}$ saturated aliphatic acid vinyl monomers such as vinyl formate, vinyl acetate, vinyl propionate and vinyl versatate.

Alkyl vinyl ether base monomers: included are alkyl vinyl ethers such as, for example, methyl vinyl ether, ethyl vinyl ether, i-propyl vinyl ether, n-butyl vinyl ether, i-butyl vinyl ether, n-amyl vinyl ether, i-amyl vinyl ether, 2-ethylhexyl vinyl ether and octadecyl vinyl ether; and cycloalkyl vinyl ethers such as, for example, cyclohexyl vinyl ether, 2-methylcyclohexyl vinyl ether and 3,3,5-trimethylcyclohexyl vinyl ether.

Halogenated vinyl base monomers: included are halogenated vinyl base monomers such as, for example, vinyl chloride, vinylidene chloride, vinyl fluoride and vinylidene fluoride.

In addition to the monomers described above, monomers capable of being used for producing the polymer of the present invention include $C_1$ to $C_{12}$ dialkyl ester monomers of $C_4$ to $C_5$ unsaturated α,β-dicarboxylic acids such as, for example, dibutyl maleate, dioctyl maleate, dibutyl fumarate, dioctyl fumarate, dibutyl itaconate and dioctyl itaconate; and cyanized vinyl base monomers such as, for example, acrylonitrile and methacrylonitrile.

The low molecular weight polymer of the present invention has preferably a polar group, and the polar group includes, for example, an acidic polar group such as a carboxyl group, a sulfone group, a phosphoric acid group and a formyl group; a basic polar group such as an amino group; and a neutral polar group such as an amide group, a hydroxyl group and a cyano group.

These polar groups can be introduced into a polymer, for example, by using radical-polymerizable unsaturated monomers having the polar groups described above as a part of the monomer component to be emulsion-polymerized. In general, the monomer having a polar group can be used in a range of 0.01 to 20% by weight, preferably 0.05 to 15% by weight and more preferably 0.1 to 10% by weight based on the total amount of the monomers to be polymerized.

Among the monomers having the polar groups described above, the monomer having an acidic polar group includes, for example, α,β-ethylenically unsaturated compounds having a carboxyl group and α,β-ethylenically unsaturated compounds having a sulfone group.

The preceding α,β-ethylenically unsaturated compounds having a carboxyl group include, for example, acrylic acid, methacrylic acid, fumaric acid, maleic acid, itaconic acid, cinnamic acid, monomethyl maleate, monobutyl maleate and monooctyl maleate.

The preceding α,β-ethylenically unsaturated compounds having a sulfone group include, for example, sulfonated ethylene, sodium salts thereof, allylsulfosuccinic acid and octyl allylsulfosuccinate.

Further, the monomers having a basic polar group include, for example, (meth)acrylates of aliphatic alcohols having an amino group, a salt of an amino group or a quaternary ammonium group and having 1 to 12 carbon atoms, preferably 2 to 8 carbon atoms and particularly preferably 2 to 4 carbon atoms, vinyl compounds substituted with a nitrogen-containing heterocyclic group and N,N-diallylalkylamine or quaternary ammonium salts thereof Among them, preferably used are (meth)acrylates of aliphatic alcohols having an amino group, a salt of an amino group or a quaternary ammonium group.

The preceding (meth)acrylates of aliphatic alcohols having an amino group, a salt of an amino group or a quaternary ammonium group include, for example, dimethylaminoethyl acrylate, dimethylaminoethyl methacrylate, diethylaminoethyl acrylate, diethylaminoethyl methacrylate, quaternary salts thereof, 3-dimethylaminophenyl acrylate and 2-hydroxy-3-methacryloxypropyltri-methylammonium salts.

The preceding vinyl compounds substituted with a nitrogen-containing heterocyclic group include, for example, vinylpyridine, vinylpyrrolidone, N-vinylimidazole, vinyl-N-methylpyridinium chloride and vinyl-N-ethylpyridinium chloride.

N,N-diallyl-alkylamine described above include, for example, N,N-diallylmethylammonium chloride and N,N-diallylethylammonium chloride.

Further, the monomers having a neutral polar group include (meth)acrylic acid amide, (meth)acrylic acid amide in which a nitrogen atom may be mono- or di-substituted with an alkyl group having 1 to 18 carbon atoms in a certain case, (meth)acrylic acid esters having a hydroxyl group and (meth)acrylonitrile having a cyano group.

Preceding (meth)acrylic acid amide in which a nitrogen atom may be mono- or di-substituted with an alkyl group having 1 to 18 carbon atoms in a certain case includes, for example, acrylamide, N-butylacrylamide, N,N-dibutylacrylamide, piperidylacrylamide, methacrylamide, N-butylmethacrylamide, N,N-dimethylacrylamide and N-octadecylacrylamide.

Preceding (meth)acrylates having a hydroxyl group include, for example, hydroxyalkyl (meth)acrylates such as 2-hydroxyethyl (meth)acrylate and 2-hydroxypropyl (meth) acrylate; allyl alcohol, 2-hydroxyethyl (meth)allyl ether and 2- or 3-hydroxypropyl (meth)allyl ether.

In addition to the radical-polymerizable unsaturated monomers described above, a small amount of compounds having two or more polymerizable double bonds can be used, if necessary, in combination for the purpose of providing the low molecular weight polymers of the present invention with a cross-linking structure to carry out emulsion polymerization. Such compounds having two or more polymerizable double bonds include, for example, aromatic divinyl compounds such as divinylbenzene and divinylnaphthalene; diethylenical carboxylic acid esters such as ethylene glycol dimethacrylate, tetraethylene glycol dimethacrylate, 1,3-butanediol dimethacrylate, 1,6-hexanediol diacrylate and allyl methacrylate; N,N-divinylaniline, divinyl ether, divinyl sulfide and triallyl cyanurate.

The emulsion polymerization in the present invention is carried out usually in the absence of the chain transfer agent but can be carried out as well, if necessary, in the presence of the chain transfer agent. Agents conventionally used for emulsion polymerization can be used likewise as the chain transfer agent capable of being used in such case and include, for example, sulfur-containing chain transfer agents such as n-dodecylmercaptan, t-dodecylmercaptan, n-butylmercaptan, 2-ethylhexyl thioglycolate and 2-mercaptoethanol; halogen-containing chain transfer agents such as trichlorobromomethane, carbon tetrachloride and bromoform; nitrogen-containing chain transfer agents such as N,N-dimethyl-formamide and pivalonitrile; in addition thereto, turbinolene, myrcel, limonene, α-pinene and β-pinene.

The chain transfer agent can usually be used according to a weight average molecular weight (Mw) desired to the resulting polymer in an amount (T represents parts by weight of the chain transfer agent used for the polymerization per 100 parts by weight of the radical-polymerizable unsaturated monomer, and when the chain transfer agent is not used, T is zero) falling in a range in which a relation shown by the following inequality is set up:

$$3 \leqq \log Mw > 4.11 - 0.91 \times \log(T+0.1) \quad (2)$$

preferably $$3.18 \leqq \log Mw > 3.85 - 0.93 \times \log(T+0.1) \quad (2\text{-}1)$$

more preferably $$3.3 \leqq \log Mw > 3.67 - 0.93 \times \log(T+0.1) \quad (2\text{-}2)$$

To be more specific, the use amount (T) of the chain transfer agent falls preferably in a range of:

$$0 \leqq T \leqq 3$$

particularly $$0 \leqq T \leqq 1$$

above all $$0 \leqq T \leqq 0.1$$

According to the emulsion polymerization in the present invention, the polymer having a low molecular weight which is equivalent to or lower than those of polymers obtained by emulsion polymerization using conventional chain transfer agents can be produced by using much smaller amounts of the chain transfer agents, and even when the chain transfer agents are used, the use amounts thereof can be reduced to a large extent.

The emulsion polymerization according to the present invention is characterized, as described above, by that it is carried out at high temperatures which have not so far been used. In the emulsion polymerization according to the present invention, the emulsion polymerization is carried out at a temperature falling in a range of 115° C. or higher, preferably 120 to 250° C., more preferably 130 to 200° C. and particularly preferably 140 to 190° C. If the polymerization temperature is lower than 115° C., it is difficult to obtain the polymer having a low molecular weight which is intended in the present invention.

Thus, since a high polymerization temperature is used in the emulsion polymerization according to the present invention, the emulsion polymerization is preferably carried out usually under pressure at which the reaction mixture is not vaporized and volatilized. In general, the polymerization is carried out preferably under a pressure (gauge pressure) of about 1 to about 50 kg/cm$^2$, preferably about 1 to 10 kg/cm$^2$. To be specific, for example, a pressure proof polymerization vessel is used, and the reaction can be carried out in a sealed state while controlling the pressure.

The emulsion polymerization according to the present invention can be carried out by polymerizing the radical-polymerizable monomers described above in an aqueous medium in the presence of the chain transfer agent on the polymerization temperature condition described above using an emulsifier, an initiator and the like.

Usually, deionized water is used as the polymerization medium, but a mixed solvent of a water miscible organic solvent such as alcohol and water can be used in a certain case. The reaction can be carried out in the air but may be carried out, if necessary, under an atmosphere of inert gas such as nitrogen and argon.

The emulsifier capable of being used in the emulsion polymerization may be any of anionic emulsifiers, nonionic emulsifiers, cationic emulsifiers and amphoteric emulsifiers, and these emulsifiers may be used alone or can be used in combination of two or more kinds thereof.

Examples of the nonionic emulsifiers described above include polyoxyethylene alkyl ethers such as, for example, polyoxyethylene lauryl ether and polyoxyethylene stearyl ether; polyoxyethylene alkylphenyl ethers such as, for example, polyoxyethylene octylphenyl ether and polyoxyethylene nonylphenyl ether; sorbitan higher fatty acid esters such as, for example, sorbitan monolaurate, sorbitan monostearate and sorbitan trioleate; polyoxyethylene sorbitan higher fatty acid esters such as, for example, polyoxyethylene sorbitan monolaurate; polyoxyethylene higher fatty acid esters such as, for example, polyoxyethylene monolaurate and polyoxyethylene monostearate; glycerin higher fatty acid esters such as, for example, monoglyceride oleate and monoglyceride stearate; in addition thereto, polyoxyethylene polyoxypropylene block copolymers.

Examples of the anionic emulsifiers described above include higher fatty acid salts such as, for example, sodium oleate; alkylarylsulfonic acid salts such as, for example, sodium dodecylbenzenesulfonate; alkylsulfuric acid salts such as, for example, sodium laurylsulfate; polyoxyethylene alkyl ethersulfuric ester salts such as, for example, sodium polyoxyethylene lauryl ethersulfate; polyoxyethylene alkylaryl ethersulfuric ester salts such as, for example, sodium polyoxyethylene nonylphenyl ethersulfate; and alkylsulfosuccinic ester salts and derivatives thereof such as sodium monooctylsulfosuccinate, sodium dioctylsulfosuccinate and sodium polyoxyethylene laurylsulfosuccinate.

The amphoteric emulsifiers described above include, for example, alkyl betaines such as lauryl betaine.

Further, fluorine base emulsifiers obtained by substituting at least a part of hydrogen atoms of the alkyl groups of these emulsifiers with fluorine can be used as well.

Examples of the cationic emulsifiers described above include octadecyltrimethylammonium chloride, dodecyltrimethylammonium chloride, hexadecyltrimethylammonium chloride, dioctadecyldimethylammonium chloride, didodecyldimethylammonium chloride, dodecylbenzyldimethylammonium chloride, tetradecylbenzyldimethylammonium chloride, octadecylbenzyldimethylammonium chloride, tetradecyltrimethylammonium chloride, dihexadecyldimethylammonium chloride, dioctadecyldimethylammonium chloride, hexadecylbenzyldimethylammonium chloride, palmityltrimethylammonium chloride, oleyltrimethylammonium chloride, dipalmitylbenzyltrimethylammonium chloride and dioleylbenzyltrimethylammonium chloride.

Further, there can be used cationic emulsifiers using as starting materials, natural vegetable oils such as coconut oil, palm oil, safflower oil, cotton seed oil, rape seed oil and linseed oil, and these cationic emulsifiers include coconut oil alkylbenzyldimethylammonium chloride and coconut oil alkyltrimethylammonium chloride. Amine acetates and hydrochlorides include dodecylamine acetate, tetradodecylamine acetate, octadecylamine acetate, dodecylamine hydrochloride, tetradecylamine hydrochloride, octadecylamine hydrochloride and hardened beef tallow amine acetate.

Further, reactive emulsifiers having polymerizable double bonds in molecular structures can be used as well, and examples of these reactive emulsifiers include a reactive emulsifier represented by the following formula (1) or (2):

(1)

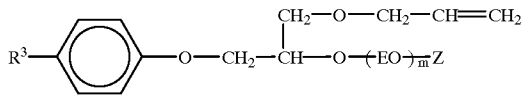

(2)

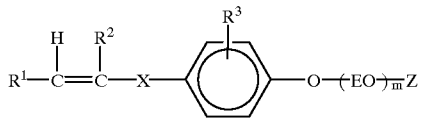

wherein $R^1$ and $R^2$ each represent independently hydrogen or a methyl group; $R^3$ represents an alkyl group having 6 to 18 carbon atoms, an alkenyl group, an aryl group or an aralkyl group; EO is —$CH_2CH_2O$—; X represents a single bond or a methylene group; Z represents hydrogen or $SO_3M$, in which M represents alkaline metal, ammonium or organic ammonium; and m is a natural number of 1 to 50.

Among the reactive emulsifiers represented by the formula (1) described above, specific examples of the anionic reactive emulsifiers in which Z is $SO_3M$ include, for example, ⌈Adeka Reasoap SE-10N⌋ (manufactured by Asahi Denka Ind. Co., Ltd.), and specific examples of the nonionic reactive emulsifiers in which Z is hydrogen include, for example, ⌈Adeka Reasoap NE-10⌋, ⌈Adeka Reasoap NE-20⌋ and ⌈Adeka Reasoap NE-30⌋ (all manufactured by Asahi Denka Ind. Co., Ltd.).

Among the reactive emulsifiers represented by the formula (2) described above, specific examples of the nonionic reactive emulsifiers in which Z is $SO_3M$ include, for example, ⌈Aquaron HS-10⌋ and ⌈Aquaron HS-20⌋ (all manufactured by Daiichi Kogyo Seiyaku Co., Ltd.), and specific examples of the nonionic reactive emulsifiers in which Z is hydrogen include, for example, ⌈Aquaron RN-10⌋, ⌈Aquaron RN-20⌋, ⌈Aquaron RN-30⌋ and ⌈Aquaron RN-50⌋ (all manufactured by Daiichi Kogyo Seiyaku Co., Ltd.).

Anionic reactive emulsifiers other than those described above include alkylsulfosuccinic acid alkenyl ether salt base reactive emulsifiers such as, for example, ⌈Latemul S-120⌋, ⌈Latemul S-120A⌋, ⌈Latemul S-180⌋ and ⌈Latemul S-180A⌋ (all manufactured by Kao Corp.); alkylsulfosuccinic acid alkenyl ester salt base reactive emulsifiers such as, for example, ⌈Eleminol JS-2⌋ (manufactured by Sanyo Kasei Ind. Co., Ltd.); methylenebispolyoxyethylene alkylphenylalkenyl ether sulfuric acid ester salt base reactive emulsifiers such as, for example, ⌈Antox MS-60⌋ (manufactured by Nippon Nyukazai Co., Ltd.); alkylalkenylsulfosuccinic acid ester salt base reactive emulsifiers such as, for example, ⌈Latemul ASK⌋ (manufactured by Kao Corp.); polyoxyalkylene (meth)acrylate sulfuric acid ester salt base reactive emulsifiers such as, for example, ⌈Eleminol RS-30⌋ (manufactured by Sanyo Kasei Ind. Co., Ltd.); polyoxyalkylene alkyl ether aliphatic unsaturated dicarboxylic acid ester salt base reactive emulsifiers such as, for example, ⌈RA-1120⌋ and ⌈RA-2614⌋ (all manufactured by Nippon Nyukazai Co., Ltd.); (meth)acrylic acid sulfoalkyl ester salt base reactive emulsifiers such as, for example, ⌈Antox MS-2N⌋ (manufactured by Nippon Nyukazai Co., Ltd.); phthalic acid dihydroxyalkyl (meth)acrylate sulfuric acid ester salt base reactive emulsifiers; and mono- or di(glycerol-1-alkylphenyl-3-allyl-2-polyoxyalkylene ether)phosphoric acid ester salt base reactive emulsifiers such as, for example, ⌈H-3330PL⌋ (manufactured by Daiichi Kogyo Seiyaku Co., Ltd.).

Nonionic reactive emulsifiers other than those described above include polyoxyalkylene alkylphenyl ether (meth) acrylate base reactive emulsifiers such as, for example, ⌈RMA-564⌋ and ⌈RMA-568⌋ (all manufactured by Nippon Nyukazai Co., Ltd.); and polyoxyalkylene alkylphenyl ether (meth)acrylate base reactive emulsifiers such as, for example, ⌈RMA-1114⌋ (manufactured by Nippon Nyukazai Co., Ltd.).

Water soluble protective colloid can be used in combination with the anionic and/or nonionic emulsifiers described above.

The water soluble protective colloid capable of being used includes polyvinyl alcohols such as, for example, partially saponified polyvinyl alcohol, fully saponified polyvinyl alcohol and modified polyvinyl alcohol; cellulose derivatives such as, for example, hydroxyethyl cellulose, hydroxypropyl cellulose and carboxymethyl cellulose salts; and natural polysaccharides such as gua gum. They can be used in a mode of single use or combined use of plural kinds.

The use amount of the emulsifiers described above can be set usually in a range of 0.03 to 10 parts by weight, preferably 0.05 to 7 parts by weight and more preferably 0.1 to 5 parts by weight per 100 parts by weight of the total of the monomers to be used.

Further, optional water soluble initiators which have so far been used for emulsion polymerization can be used likewise as the initiator capable of being used for the emulsion polymerization according to the present invention.

A group of suitable initiators are free radical initiators such as hydrogen peroxide, some specific alkyl hydroperoxides, dialkyl peroxides, persulfates, peresters, percarbonates, ketone peroxides and azo initiators. Specific examples of the suitable free radical initiators include hydrogen peroxide, t-butyl hydroperoxide, di-tert-butyl peroxide, ammonium persulfate, potassium persulfate, sodium persulfate, tert-amyl hydroperoxide, methyl ethyl ketone peroxide, 2,2'-azobis(2-amidinopropane) and 2,2'-azobis(4-cyanovaleric acid). From the viewpoint that the water resistance of the polymer is not reduced, preferred are nonionic catalysts such as hydrogen peroxide, alkyl hydroperoxides, dialkyl peroxides, peresters, percarbonates, ketone peroxides and azo initiators, and hydrogen peroxide is particularly preferred.

In general, the use amount of such free radical initiator falls preferably in a range of 0.05 to 50 parts by weight, more preferably 0.2 to 30 parts by weight and particularly preferably 1 to 10 parts by weight per 100 parts by weight of the total of the monomers used. The reaction temperature and the use amount of the free radical initiator are controlled depending on the molecular weight desired to the intended polymer.

A water soluble redox initiator obtained by combining a water soluble peroxide with a water soluble reducing agent can be used as well. The peroxide used for the water soluble redox initiator includes the peroxides described above, and there can be used as the reducing agent, for example, sodium bisulfite, sodium pyrosulfite, sodium sulfite, hypophosphites, ascorbic acid and formaldehydesodium sulfoxylate.

In general, the use amount of the reducing agent in the redox catalyst can fall in a range of 0.05 to 50 parts by weight per 100 parts by weight of the total of the monomers used.

Further, in addition to the redox catalysts described above, a trace amount of transition metal, for example, ferrous sulfate and Mohr's salt copper sulfate can be used in combination.

The radical-polymerizable unsaturated monomer, the chain transfer agent, the emulsifier, the initiator and the aqueous medium each described above can be added to a polymerization vessel in one lot to be reacted, or at first, a part of them is added and heated to start polymerization, and then the remainder can be gradually added to carry out the polymerization. In general, the latter method is preferred from the viewpoint that the polymerization temperature can readily be controlled. Further, the radical-polymerizable unsaturated monomer is mixed in advance with the emulsifier and the aqueous medium to prepare an emulsion of the monomer, and this emulsion is added to the polymerization vessel to carry out polymerization, whereby the emulsion polymerization can stably be advanced.

Further, the emulsion polymerization can be carried out by a so-called power feed polymerization method in which polymerization is carried out while changing the composition of monomers and a so-called seed polymerization method in which a polymer emulsion is added in advance and then polymerization is started.

Further, the initiator may be added at first in one lot, or first a small amount, for example, 0.1 to 2 parts by weight, preferably 0.5 to 1 part by weight per 100 parts by weight of the total of the monomers is added, and then the remainder may be added intermittently, semi-continuously or continuously after starting the polymerization. The addition thereof can be finished usually in 5 minutes to 5 hours, preferably 30 minutes to 4 hours and more preferably 1 to 3 hours.

The emulsion polymerization described above turns usually a great part of the monomer fed into a polymer and allows the unreacted monomer to scarcely remain. However, if it is desired to further reduce the content of the residual monomer, the residual monomer can be reduced by a method in which the initiator is added to the reaction mixture after the polymerization to further promote the polymerization of the residual monomer or nitrogen or air is blown to thereby remove the residual monomer.

Thus, an emulsified dispersion containing a polymer having a low molecular weight is obtained. Polymer particles contained in the above emulsified dispersion can have a particle diameter falling in a range of usually 0.01 to 2 $\mu$m, preferably 0.02 to 1 $\mu$m and more preferably 0.05 to 0.5 $\mu$m. The polymer contained in the above emulsified dispersion has a concentration (solid matter concentration) falling usually in a range of 20 to 80% by weight, preferably 30 to 70% by weight and more preferably 40 to 65% by weight, and the above emulsified dispersion has a viscosity (BH type rotary viscometer, 25° C., 20 rpm; hereinafter the same viscosity measuring conditions apply) falling usually in a range of 10,000 cps or less, particularly 5 to 5,000 cps.

The low molecular weight polymer emulsified dispersion thus obtained can be used as it is for preparing a toner and can be used, if necessary, in a mixture with a high molecular weight polymer emulsified dispersion.

The high molecular weight polymer emulsified dispersion to be mixed may be a dispersion obtained by emulsifying a high molecular weight polymer produced by a method such as a solution polymerization method and a suspension polymerization method in an aqueous medium. In general, however, preferably used is a dispersion produced by emulsion-polymerizing the same radical-polymerizable unsaturated monomer as described above in an aqueous medium at a temperature of 100° C. or lower, preferably about 5 to about 90° C. under ordinary conditions in the substantial absence of the chain transfer agent using such the emulsifier, the polymerization initiator and the like as described above.

The high molecular weight polymer contained in such high molecular weight polymer emulsified dispersion has preferably a weight average molecular weight Mw of larger than 100,000, a number average molecular weight Mn of larger than 35,000 and a molecular weight (molecular weight peak) Mp of larger than 80,000 which shows a maximum value in a gel permeation chromatography (GPC) chart, more preferably a weight average molecular weight Mw falling in a range of 300,000 to 1,000,000, a number average molecular weight Mn falling in a range of 100,000 to 300,000 and a molecular weight peak Mp falling in a range of 200,000 to 600,000.

The above high molecular weight polymer can have a glass transition temperature (Tg) falling in a range of usually 0 to 90° C., preferably 30 to 80° C. and more preferably 50 to 70° C. Further, the above high molecular weight polymer has preferably a gel content falling in a range of usually 0 to 99% by weight, particularly 0 to 70% by weight and further particularly 0 to 50% by weight.

The particle diameter and the concentration (solid matter concentration) of the polymer particles contained in the high molecular weight polymer emulsified dispersion and the viscosity of the above emulsified dispersion can fall in the same ranges as described above in the case of the low molecular weight polymer emulsified dispersion.

The blending proportion of both the low molecular weight polymer emulsified dispersion and the high molecular weight polymer emulsified dispersion described above in the case of using them in a mixture shall not specifically be restricted and can be varied over a wide range depending on characteristics required for the toner products. In general, the weight ratio (L/H) of the above low molecular weight polymer emulsified dispersion (L) to the high molecular weight polymer emulsified dispersion (H) contained in the above emulsified dispersion can fall in a range of 95/5 to 50/50, preferably 90/10 to 60/40 and more preferably 85/15 to 65/35.

In place of mechanical mixing of the low molecular weight polymer emulsified dispersion with the high molecular weight polymer emulsified dispersion, a high molecular weight polymer can be emulsion-polymerized according to a seed emulsion polymerization method in the presence of the low molecular weight polymer emulsified dispersion produced by the preceding emulsion polymerization method of the present invention (hereinafter referred to as an A method), or a low molecular weight polymer can be emulsion-polymerized in the presence of the high molecular weight polymer emulsified dispersion according to the emulsion polymerization method of the present invention (hereinafter referred to as a B method).

This can provide an emulsified dispersion in which the high molecular weight polymer and the low molecular weight polymer are dispersed in the form of composite particles in which they are tightly integrated, and a toner which holds toner characteristics of a blocking property and a fixing property which are incompatible with each other at a good balance can be obtained. As a result thereof, a production design area of a toner for producing an electrostatic image can be broadened.

The seed emulsion polymerization described above can be carried out by newly adding a radical-polymerizable unsaturated monomer to the low molecular weight or high molecular weight polymer emulsified dispersion which is a seed and emulsion-polymerizing them. This emulsion polymerization allows the particle diameter of the dispersed particles to grow large and the solid matter concentration of the emulsified dispersion to increase as well, and therefore the polymer particles contained in the polymer emulsified dispersion which is the seed have preferably an average particle diameter falling in a range of usually 0.01 to 1.5 $\mu$m, particularly 0.01 to 1 $\mu$m and further particularly 0.01 to 0.5

μm. Further, the polymer emulsified dispersion which is the seed have preferably a solid matter concentration which is controlled in a range of usually 20 to 70% by weight, particularly 25 to 65% by weight and further particularly 30 to 60% by weight.

The same monomers as described above in the case of the emulsion polymerization according to the present invention can be used for the radical-polymerizable unsaturated monomer added to the polymer emulsified dispersion which is the seed. The above monomer may be added as it is to the polymer emulsified dispersion but is preferably added after usually emulsified in an aqueous medium together with an emulsifier. It may be added in one lot or can be added continuously or intermittently. However, it is preferably added continuously from the viewpoint of stability in the seed emulsion polymerization.

The composition of the monomer constituting the polymer contained in the polymer emulsified dispersion which is the seed may be the same as or different from the composition of the monomer to be newly polymerized according to the seed emulsion polymerization and can suitably be selected depending on physical properties required to a targeted toner. Also in the glass transition temperature (Tg) of the polymer, the Tg of the polymer contained in the polymer emulsified dispersion which is the seed may be the same as or different from the Tg of the polymer which is newly formed according to the seed emulsion polymerization. The composite polymer particles formed has preferably a Tg falling in a range of usually 0 to 90° C., particularly 30 to 80° C. and further particularly 50 to 70° C.

In carrying out the seed emulsion polymerization, an emulsifier and/or a polymerization initiator can be supplemented, if necessary, to the polymer emulsified dispersion which is the seed. In general, the polymerization initiator is preferably added after adding at least a part of the radical-polymerizable unsaturated monomer and stirring and mixing at a prescribed temperature for some time. This allows the polymerization to be carried out in the state that a larger amount of the radical-polymerizable unsaturated monomer is present on the surface of the polymer particles contained in the polymer emulsified dispersion which is the seed and makes it possible to form more homogeneous composite polymer particles.

To be specific, the A method described above can be carried out, for example, by emulsion-polymerizing first the radical-polymerizable unsaturated monomer at a high temperature of 115° C. or higher according to the emulsion polymerization of the present invention to form a low molecular weight polymer emulsified dispersion, then lowering the temperature to 100° C. or lower, preferably about 5 to about 90° C. and suitably supplementing the radical-polymerizable unsaturated monomer and/or the polymerization initiator to further emulsion-polymerize them. In this case, high temperature emulsion polymerization at a preceding stage is preferably carried out without using a chain transfer agent, but if used, it is preferably used in a small amount of such an extent that a substantial effect is not exerted on the control of the polymerization degree of a high molecular weight polymer in emulsion polymerization at a subsequent stage.

To be specific, the B method described above can be carried out, for example, by emulsion-polymerizing first the radical-polymerizable unsaturated monomer at a temperature of 100° C. or lower, preferably about 5 to about 90° C. under ordinary conditions without using substantially the chain transfer agent to form the high molecular weight polymer emulsified dispersion, then elevating the temperature to 115° C. or higher and suitably supplementing the radical-polymerizable unsaturated monomer and/or the polymerization initiator to further emulsion-polymerize them.

As a result thereof, the emulsified dispersion containing the composite polymer particles having a form in which the core of the low molecular weight polymer is covered with the high molecular weight polymer is usually obtained in the A method. Obtained in the B method is the emulsified dispersion containing the composite polymer particles having a form in which the core of the high molecular weight polymer is covered with the low molecular weight polymer.

The weight ratio (L/H) of the low molecular weight polymer (L) to the high molecular weight polymer (H) contained in such composite polymer particles can fall, as is the case with that described above, in a range of 95/5 to 50/50, preferably 90/10 to 60/40 and more preferably 85/15 to 65/35.

The toner of the present invention is preferably prepared from the low molecular weight polymer emulsified dispersion described above, the mixture of the low molecular weight polymer emulsified dispersion and the high molecular weight polymer emulsified dispersion or the emulsified dispersion containing the composite polymer particles described above, according to a so-called ⌈resin fine particle coagulation method⌋ (refer to the specifications of Japanese Patent 2,537,503 and U.S. Pat. No. 4,996,127).

This resin fine particle coagulation method comprises fundamentally adding a colorant and, if necessary, additives such as magnetic powder, an electrostatic charge-controlling agent, a releasing agent and the like to the low molecular weight polymer emulsified dispersion, the mixture of the low molecular weight polymer emulsified dispersion and the high molecular weight polymer emulsified dispersion or the emulsified dispersion containing the composite polymer particles, which are produced in the manners described above, to disperse them uniformly, then coagulating the polymer particles together with the colorant particles and the like to form a dispersion containing associated particles which have a volume-average particle diameter falling in a range of usually 1 to 15 μm, preferably 3 to 10 μm, and subsequently subjecting the dispersion of the associated particles to fusion treatment, followed by drying, and this can provide toner particles which have a volume-average particle diameter falling in a range of usually 1 to 15 μm, preferably 3 to 10 μm and which have a fine particle diameter, a narrow particle size distribution and a uniform composition.

To be more specific, prescribed amounts of the colorant and, if necessary, additives such as an electrostatic charge-controlling agent, magnetic powder, a releasing agent, a fluidizing agent and an abrasive are added and blended with the low molecular weight polymer emulsified dispersion or the mixture of the low molecular weight polymer emulsified dispersion and the high molecular weight polymer emulsified dispersion to uniformly disperse them, and stirring is continued for suitable time, for example, 0.5 to 10 hours, preferably 1 to 5 hours. In this case, treatments such as heating, addition of inorganic salts and controlling of pH are suitably carried out in combination in order to reduce the stability of the dispersion, whereby the particle diameter of the finally resulting associated particles can be controlled. For example, almost for initial 0.5 to 4 hours, stirring is carried out while heating at a relatively low temperature falling in a range of about 20 to about 50° C., and then the temperature is elevated by about 20 to about 40° C. in a certain case to further continue stirring almost for 0.5 to 2 hours. Subsequently, an acid or an alkali is added, if necessary, to control the pH of the dispersion to near neutrality (pH 7), and then the temperature can be elevated to about 60 to about 100° C. by heating to further continue stirring.

As a result thereof, the polymer particles (primary particles) contained in the emulsified dispersion and the colorant particles are coagulated gradually in company with the other additives and finally, associate particles having a volume-average particle diameter falling in a range of usually 1 to 15 μm, preferably 3 to 10 μm can be formed.

The associated particles formed in such manner as described above have a form which is irregular and heavily uneven. An aqueous dispersion of these associate particles is continued to be stirred at a temperature falling in a range of the glass transition temperature (Tg) of the polymer constituting the particles to (Tg+85)°C., particularly the Tg to (Tg+20)°C., and then contact parts between the polymer fine particles (primary particles) constituting the associated particles and/or secondary particles which are formed temporarily by allowing the above particles to be coagulated are fused with each other, so that fusion and integration of the respective particles are promoted. On the other hand, the shape is turned little by little from an irregular and uneven state to a smooth surface and gradually comes up to a sphere, and the volume-average particle diameter becomes a little small (usually 1 to 15 μm, preferably 3 to 10 μm). This fusion treatment can be carried out usually for 1 to 6 hours, preferably almost 2 to 4 hours.

The associated particles thus fused and integrated are separated from the dispersion and dried, whereby the toner of the present invention can be obtained.

The colorant used in preparing the toner described above includes inorganic pigments, organic pigments and synthetic dyes, and they can be used in suitable combination of two or more kinds thereof.

The inorganic pigments described above include, for example, metal powder base pigments such as zinc powder, iron powder and copper powder; metal oxide base pigments such as magnetite, ferrite, red iron oxide, titanium oxide, zinc white, silica, chromium oxide, ultramarine, cobalt blue, cerulean blue, mineral violet and trilead tetraoxide; carbon base pigments such as carbon black, thermatomic carbon and furnace black; sulfide base pigments such as zinc sulfide, cadmium red, selenium red, mercury sulfide and cadmium yellow; chromate base pigments such as molybdenum red, barium yellow, strontium yellow and Chrome Yellow; and ferrocyanide base pigments such as Milori blue.

The organic pigments described above include, for example, azo base pigments such as benzidine yellow, benzidine orange, permanent red 4R, pyrazolone red, lithol red, brilliant scarlet G and Bonmaloon light; acid dye base and basic dye base pigments such as those obtained by precipitating dyes such as Orange II, Acid Orange R, eosin, quinoline yellow, Tartrazine Yellow, acid green, peacock blue and alkali blue with a precipitant, and those obtained by precipitating dyes such as rhodamine, magenta, malachite green, methyl violet and Victoria Blue with tannic acid, tartar emetic, phosphotungstic acid, phosphomolybdic acid and phosphotungstenmolybdic acid; mordant dye base pigments such as metal salts of hydroxy-anthraquinones, and alizarin murder lake; phthalocyanine base pigments such as phthalocyanine blue and sulfonated copper phthalocyanine; and quinacridone base and dioxane base pigments such as quinacridone red, quinacridone violet and carbazole dioxane violet.

The synthetic dyes described above include, for example, acridine dyes, aniline black, anthraquinone dyes, azine dyes, azo dyes, azomethine dyes, benzo- and naphthoquinone dyes, indigo dyes, indophenols, indoanilines, indamines, leuco vat dye esters, naphthalimide dyes, nigrosine, induline, nitro and nitroso dyes, oxazine and dioxazine dyes, oxidation dyes, phthalocyanine dyes, polymethine dyes, quinophthalone dyes, sulfide dyes, tri- and diallyl-methane dyes, thiazine dyes and xanthene dyes. Aniline black, nigrosine dyes and azo dyes are preferably used, and among the azo dyes, those which have salicylic acid, naphthoic acid or 8-oxyquinoline residue in a molecule and which form complex salts with metals such as chromium, copper, cobalt, iron, aluminum and the like are more preferably used.

These colorants can be used in a proportion of usually 1 to 120 parts by weight, preferably 3 to 100 parts by weight and more preferably 4 to 90 parts by weight per 100 parts by weight of the binder resin.

With respect to the electrostatic charge-controlling agents which are suitably compounded into the toner of the present invention, those for positive charge include, for example, nigrosine base electron-donating dyes, metal salts of naphthenic acid or higher fatty acids, alkoxylated amines, quaternary ammonium salts, alkyl-amides, chelates, pigments and fluorine-treated active agents. Those for negative charge include, for example, electron-accepting organic complexes, chlorinated paraffins, chlorinated polyesters, polyesters having excess acid groups and sulfonylamines of copper phthalocyanine.

Various ones such as ferromagnetic metals and metal oxides are used as the magnetic powder, and magnetite, ferrite and those obtained by subjecting them to coupling treatment are preferably used.

The releasing agents include, for example, metal salts of higher fatty acids such as a Cd, Ba, Ni, Co, Sr, Cu, Mg or Ca salt of stearic acid, a Zn, Mn, Fe, Co, Cu, Pb or Mg salt of oleic acid, a Zn, Co, Cu, Mg, Si or Ca salt of palmitic acid, a Zn, Co or Ca salt of linoleic acid, a Zn or Cd salt of ricinolic acid, a Pb salt of caprylic acid and a Pb salt of caproic acid, natural and synthetic paraffins and fatty acid esters or partially saponified products thereof, and alkylenebis fatty acid amides. They can be used alone or in suitable combination of two or more kinds thereof.

The fluidizing agents as a surface treating agent include, for example, metal oxides such as silica and titanium oxide, and those obtained by subjecting them to hydrophobicity-providing treatment. The abrasives include, for example, various metal powders, metal oxide powders and an Sr or Ba salt of titanic acid each having controlled particle sizes.

The toner prepared in the manner described above uses as a binder resin, the low molecular weight polymer having the specific weight average molecular weight described above and the specific content of chain transfer agent fragments, so that not only it has no problem on odor and is excellent in a fixing property but also has a small particle diameter, a narrow particle size distribution and a uniform composition. Use of the toner of the present invention makes it possible to form an image having a higher resolution than those of images formed by conventional toners.

EXAMPLES

The present invention shall more specifically be explained below with reference to examples and comparative examples, but the scope of the present invention shall not be restricted only to these examples. The physical properties were evaluated by the following test methods.

(1) Average Particle Diameter

The median diameter based on a volume is determined by means of Coulter Multisizer II manufactured by Nikkaki Co., Ltd.

(2) Glass Transition Temperature

The extrapolated glass transition-starting temperature is measured by means of a differential scanning calorimeter DSC-50 manufactured by Shimadzu Seisakusho Co., Ltd.

(3) Degree of Weight Average of Polymerization

Determined by means of a gel permeation chromatograph HLC-8020 manufactured by Toso Co., Ltd.

(4) Blocking Property

The toner is stored in a thermostatic chamber of 60° C. for 24 hours, and the blocking degree of the toner is evaluated by visual observation according to the following criteria:

○: no blocking is observed

Δ: slight blocking in the form of a cake is observed

×: solid blocking is observed (5) Image Density (ID)

The solid black part is measured by means of a reflection densitometer RD-914 manufactured by Macbeth Division of Kollmorgen Instruments Corporate.

(6) Resolution

The number of lines per mm in an image outputted by a printer (Laser Printer 4039 manufactured by International Business Machines Corporate) is confirmed by visual observation to evaluate the resolution. In the present evaluation method, the larger value of the resolution means the higher resolution.

(7) Fog Density

The whiteness degree is measured by means of an ND-504DE type color-difference meter manufactured by Nippon Electron Ind. Co., Ltd. The color differences L, a and b are determined, and from the whiteness degree of a blank paper before printing:

$$K_0=100-\{(100-L)^2+a^2+b^2\}^{1/2}$$

and the whiteness degree of the non-image part after printing:

$$K=100-\{(100-L)^2+a^2+b^2\}^{1/2}$$

the fog density is determined according to the following equation:

$$\text{fog density } (\%) K/K_0 \times 100$$

The lower the value of the fog density, the better, and it can be judged that the fog density is good if the value is 0.3 or less and inferior if it is 0.5 or more.

(8) Fixing on Blade

Printed are 10,000 sheets by means of a printer (IBM 4039), and fixing on a regulation blade is confirmed by visual observation to evaluate it according to the following criteria:

◎: no fixing is observed

○:partial fixing is observed but no influence is exerted on image

×: partial fixing is observed, and an influence is exerted on image

××: fixing is observed on the whole surface of the blade, and printing is impossible (9) Fixing Strength A solid black area of 2.5 cm×2.5 cm is printed on three parts in a lateral direction of a printing paper by means of the printer (IBM 4039), and the recording density is measured by means of the reflection densitometer RD-914. A mending tape (Scotch Mending Tape 810) is stuck softly on the recorded part where the density thereof has been measured, and a cylindrical weight of 1 kg is slowly reciprocated once on the tape. Then, the mending tape is peeled at 180 degrees toward the recording face, and the residual density is measured at the part where the recording density thereof has been measured before peeling. The fixing strength is calculated according to the following equation:

$$\text{fixing strength } (\%) = \frac{\text{residual density}}{\text{initial density}} \times 100$$

The higher the value of the fixing strength, the better, and it can be judged that the fixing strength is good if the value is 90% or more and inferior if it is 80% or less.

(10) Odor

After solid black printing of 10 sheets is continuously carried out by means of the printer (IBM 4039), odor is evaluated by sensory observation according to the following criteria:

○: no odor is felt

Δ: slight odor is felt

×: odor is felt

Example 1

Preparation of Emulsion Polymerization Liquid 1

A vessel equipped with a dropping pump was charged with 31 parts by weight of deionized water, 2.5 parts by weight of ⌈Neogen R⌋ (anionic emulsifier; sodium alkylbenzenesulfonate; effective ingredient: about 60% by weight; manufactured by Daiichi Kogyo Seiyaku Co., Ltd.) and 0.8 part by weight of ⌈STK-199⌋ [polyoxyethylene (n=about 30) nonylphenyl ether; effective ingredient: about 70% by weight; manufactured by Kao Corp.] and stirred to dissolve them. Then, a monomer mixed solution comprising 85 parts by weight of styrene, 15 parts by weight of butyl acrylate and 3 parts by weight of acrylic acid was dropwise added while stirring to obtain a monomer emulsion.

Next, a pressure proof reactor equipped with a stirrer, a pressure gauge, a thermometer and a dropping pump was charged with 120 parts by weight of deionized water and 0.3 part by weight of the anionic emulsifier ⌈Neogen R⌋ and substituted with nitrogen. Then, it was tightly sealed and heated to 145° C.

Added to the pressure proof reactor was 5 parts by weight of a 5weight % hydrogen peroxide aqueous solution, and then the monomer emulsion described above and 75 parts by weight of the 5 weight % hydrogen peroxide aqueous solution were added at 145° C. in 3 hours. Thereafter, the reactor was maintained at the same temperature for 2 hours to obtain an aqueous styrene base polymer dispersion.

The polymer dispersion was separated by means of a ultra-centrifugal separator and then analyzed to find, as a result thereof, that it had a weight average molecular weight (Mw) of 12,000, a number average molecular weight (Mn) of 5,000, a molecular weight peak (Mp) of 8,000, Mw/Mn of 2.4 and a gel content of 4.5 % by weight and that it had a very little odor.

Preparation of Toner

The following mixture was heated to 25° C. while stirring by means of a disperser to obtain a dispersion.

| | |
|---|---|
| Emulsion polymerization liquid 1 | 188 parts by weight |
| Carbon black ( ⌈Printex 150T⌋ manufactured by Degussa Japan Co., Ltd.) | 5 parts by weight |
| Azo dye ( ⌈Bontron S-34⌋ manufactured by Orient Chemical Ind. Co., Ltd.) | 1 part by weight |
| Wax ( ⌈Biscol 550P⌋ , 50% emulsion; manufactured by Sanyo Kasei Ind. Co., Ltd.) | 5 parts by weight |
| Water | 310 parts by weight |

Next, the dispersion described above was heated up to 55° C. after stirred for about 2 hours and adjusted to pH 7.0 with ammonia. Further, the dispersion was heated up to 85° C. and continued to be stirred at 85° C. for 2 hours to obtain a coagulated matter of about 6 pm, and this was a toner dispersion sample. This dispersion was cooled, separated, washed with water and then dried to obtain toner particles. One part by weight of hydrophobic silica was added and mixed with 100 parts by weight of the toner particles thus obtained by means of a Henschel mixer to prepare a developer for test.

The developer described above was loaded in a commercial printer (IBM 4039) to carry out printing to find that a printed image having a high printing density, an excellent resolution, less fog and a high fixing strength was obtained and that fixing odor was not produced. However, slight hot offset was caused. The 10000 sheet life characteristic was evaluated and as a result thereof, slight fixing on a regulation blade was observed. The results thereof are summarized in Table 1.

Example 2

Preparation of Emulsion Polymerization Liquid 2

A vessel equipped with a dropping pump was charged with 31 parts by weight of deionized water, 2.5 parts by weight of [Neogen R] and 0.8 part by weight of [STK-199] and stirred to dissolve them. Then, a monomer mixed solution comprising 70 parts by weight of styrene, 30 parts by weight of butyl acrylate and 3 parts by weight of acrylic acid was dropwise added while stirring to obtain a monomer emulsion.

Next, a reactor was charged with 120 parts by weight of deionized water and 0.3 part by weight of [Neogen R] and heated to 80° C.

Added to the reactor was 5 parts by weight of a 5 weight % hydrogen peroxide aqueous solution, and then the monomer emulsion described above and 30 parts by weight of the 5 weight % hydrogen peroxide aqueous solution were added at 80° C. in 3 hours. Thereafter, the reactor was maintained at the same temperature for 2 hours to obtain an aqueous styrene base polymer dispersion.

The polymer dispersion was separated by means of an ultra-centrifugal separator and then analyzed to find, as a result thereof, that it had a weight average molecular weight (Mw) of 500,000, a number average molecular weight (Mn) of 110,000, a molecular weight peak (Mp) of 400,000, Mw/Mn of 4.5 and a gel content of 32.0% by weight.

Preparation of Emulsion Polymerization Liquid 3

The same composition and reactor as in Example 1 were used to obtain an aqueous styrene base polymer dispersion in the same manner as in Example 1, except that the reaction temperature was changed to 155° C.

The polymer dispersion was separated by means of a ultra-centrifugal separator and then analyzed to find, as a result thereof, that it had a weight average molecular weight (Mw) of 10,000, a number average molecular weight (Mn) of 4,500, a molecular weight peak (Mp) of 6,000, Mw/Mn of 2.2 and a gel content of 3.0 % by weight and that it had a very little odor.

Preparation of Toner

The following mixture was heated at 25° C. while stirring by means of a disperser to obtain a dispersion.

| | |
|---|---|
| Emulsion polymerization liquid 2 | 40 parts by weight |
| Emulsion polymerization liquid 3 | 148 parts by weight |
| Carbon black ( [Printex 150T] manufactured by Degussa Japan Co., Ltd.) | 5 parts by weight |
| Azo dye ( [Bontron S-34] manufactured by Orient Chemical Ind. Co., Ltd.) | 1 part by weight |
| Wax ( [Biscol 550P] , 50% emulsion; manufactured by Sanyo Kasei Ind. Co., Ltd.) | 5 parts by weight |
| Water | 310 parts by weight |

Next, the dispersion described above was heated up to 60° C. after stirred for about 2 hours and adjusted to pH 7.0 with ammonia. Further, the dispersion was heated up to 90° C. and continued to be stirred at 90° C. for 2 hours to obtain a coagulated matter of about 6 $\mu$m, and this was a toner dispersion sample. This dispersion was cooled, separated, washed with water and then dried to obtain toner particles. The resulting toner particles were used to obtain a developer for testing by the same method as in Example 1, and printing was carried out to find that a printed image having a high printing density, an excellent resolution, less fog and a high fixing strength was obtained and that fixing odor was not produced. Further, the 10000 sheet life characteristic was evaluated and as a result thereof, no fixing on a regulation blade was observed. The results thereof are summarized in Table 1.

Example 3

Preparation of Emulsion Polymerization Liquid 4

A vessel equipped with a dropping pump was charged with 31 parts by weight of deionized water, 2.5 parts by weight of [Neogen R] and 0.8 part by weight of [STK-199] and stirred to dissolve them. Then, a monomer mixed solution comprising 85 parts by weight of styrene, 15 parts by weight of butyl acrylate and 3 parts by weight of acrylic acid was dropwise added while stirring to obtain a monomer emulsion.

Next, a pressure proof reactor equipped with a stirrer, a pressure gauge, a thermometer and a dropping pump was charged with 120 parts by weight of deionized water and 0.3 part by weight of [Neogen R] and substituted with nitrogen. Then, it was tightly sealed and heated to 145° C.

Added to the pressure proof reactor was 5 parts by weight of a 5 weight % hydrogen peroxide aqueous solution, and then the monomer emulsion described above and 75 parts by weight of the 5 weight % hydrogen peroxide aqueous solution were added at 145° C. in 3 hours. Thereafter, the reactor was maintained at the same temperature for 2 hours to obtain an aqueous styrene base polymer dispersion.

The polymer dispersion was separated by means of an ultra-centrifugal separator and then analyzed to find, as a result thereof, that it had a weight average molecular weight (Mw) of 12,000, a number average molecular weight (Mn) of 5,000, a molecular weight peak (Mp) of 8,000, Mw/Mn of 2.4 and a gel content of 3.5 % by weight and that it had a very little odor.

Preparation of emulsion polymerization liquid 5

A vessel equipped with a dropping pump was charged with 31 parts by weight of deionized water, 2.5 parts by weight of [Neogen R] and 0.8 part by weight of [STK-199] and stirred to dissolve them. Then, a monomer mixed solution comprising 70 parts by weight of styrene, 30 parts by weight of butyl acrylate and 3 parts by weight of acrylic acid was dropwise added while stirring to obtain a monomer emulsion.

Next, a reactor equipped with a stirrer, a thermometer and a dropping pump was charged with 400 parts by weight of the emulsion polymerization liquid 4 described above, 183 parts by weight of deionized water and 0.3 part by weight of [Neogen R] and heated to 80° C.

Added to the reactor was 2 parts by weight of a 5 weight % hydrogen peroxide aqueous solution, and then the monomer emulsion described above and 15 parts by weight of the 5 weight % hydrogen peroxide aqueous solution were added at 80° C. in 3 hours. Thereafter, the reactor was maintained at the same temperature for 2 hours to obtain an aqueous styrene base polymer dispersion.

The polymer dispersion was separated by means of an ultra-centrifugal separator and then analyzed to find, as a result thereof, that it had a weight average molecular weight (Mw) of 100,000, a number average molecular weight (Mn)

of 5,600, a molecular weight peak (Mp) of 8,000, Mw/Mn of 17.9 and a gel content of 12.3% by weight and that it had a very little odor.

Preparation of Toner

A developer for testing was obtained by the same composition and method in Example 2, except that 188 parts by weight of the emulsion polymerization liquid 5 was substituted for the emulsion polymerization liquid 2 and 3, and printing was carried out to find that a printed image having a high printing density, an excellent resolution, less fog and a high fixing strength was obtained and that fixing odor was not produced. Further, the 10000 sheet life characteristic was evaluated and as a result thereof, no fixing on a regulation blade was observed. The results thereof are summarized in Table 1.

Example 4

Preparation of Emulsion Polymerization Liquid 6

A vessel equipped with a dropping pump was charged with 31 parts by weight of deionized water, 2.5 parts by weight of [Neogen R] and 0.8 part by weight of [STK-199] and stirred to dissolve them. Then, a monomer mixed solution comprising 70 parts by weight of styrene, 30 parts by weight of butyl acrylate and 3 parts by weight of acrylic acid was dropwise added while stirring to obtain a monomer emulsion.

Next, a reactor was charged with 183 parts by weight of deionized water and 0.3 part by weight of [Neogen R] and heated to 80° C.

Added to the reactor was 2 parts by weight of a 5 weight % hydrogen peroxide aqueous solution, and then the monomer emulsion described above and 15 parts by weight of the 5 weight % hydrogen peroxide aqueous solution were added at 80° C. in 3 hours. Thereafter, the reactor was maintained at the same temperature for 2 hours to obtain an aqueous styrene base polymer dispersion.

The polymer dispersion was separated by means of an ultra-centrifugal separator and then analyzed to find, as a result thereof, that it had a weight average molecular weight (Mw) of 500,000, a number average molecular weight (Mn) of 110,000, a molecular weight peak (Mp) of 400,000, Mw/Mn of 4.5 and a gel content of 29.5% by weight.

Preparation of Emulsion Polymerization Liquid 7

A vessel equipped with a dropping pump was charged with 31 parts by weight of deionized water, 2.5 parts by weight of [Neogen R] and 0.8 part by weight of [STK-199] and stirred to dissolve them. Then, a monomer mixed solution comprising 85 parts by weight of styrene, 15 parts by weight of butyl acrylate and 3 parts by weight of acrylic acid was dropwise added while stirring to obtain a monomer emulsion.

Next, a pressure proof reactor equipped with a stirrer, a pressure gauge, a thermometer and a dropping pump was charged with 25 parts by weight of the emulsion polymerization liquid 6 described above, 120 parts by weight of deionized water and 0.3 part by weight of [Neogen R] and substituted with nitrogen. Then, it was tightly sealed and heated to 145° C.

Added to the pressure proof reactor was 5 parts by weight of a 5 weight % hydrogen peroxide aqueous solution, and then the monomer emulsion described above and 75 parts by weight of the 5 weight % hydrogen peroxide aqueous solution were added at 145° C. in 3 hours. Thereafter, the reactor was maintained at the same temperature for 2 hours to obtain an aqueous styrene base polymer dispersion.

The polymer dispersion was separated by means of an ultra-centrifugal separator and then analyzed to find, as a result thereof, that it had a weight average molecular weight (Mw) of 110,000, a number average molecular weight (Mn) of 5,800, a molecular weight peak (Mp) of 7,000 and Mw/Mn of 19.0 and that it had a very little odor.

Preparation of Toner

A developer for testing was obtained by the same composition and method in Example 2, except that 188 parts by weight of the emulsion polymerization liquid 7 was substituted for the emulsion polymerization liquid 2 and 3, and printing was carried out to find that a printed image having a high printing density, an excellent resolution, less fog and a high fixing strength was obtained and that fixing odor was not produced. Further, the 10000 sheet life characteristic was evaluated and as a result thereof, no fixing on a regulation blade was observed. The results thereof are summarized in Table 1.

Comparative Example 1

Preparation of emulsion polymerization liquid 9

An aqueous styrene base polymer dispersion was obtained in the same reactor as in Example 1, except that 6 parts by weight of bromotrichloromethane which was a chain transfer agent was further added to the monomer mixed solution having the same composition as in Example 1 and the reaction temperature was changed to 90° C.

The polymer dispersion was separated by means of an ultra-centrifugal separator and then analyzed to find, as a result thereof, that it had a weight average molecular weight (Mw) of 10,500, a number average molecular weight (Mn) of 4,800, a molecular weight peak (Mp) of 6,200, Mw/Mn of 2.2, a gel content of 6.3% by weight and an S value of 0.0353 (equivalent/100 g of the polymer) and that strong odor was felt.

Preparation of Toner

A developer for test was obtained by the same composition and method in Example 2, except that 148 parts by weight of the emulsion polymerization liquid 9 was substituted for the emulsion polymerization liquid 3, and printing was carried out to find that though the printing density was high, the resolution was a little inferior and a lot of fog was produced and that the fixing strength was a little inferior and odor was observed to be produced. The results thereof are summarized in Table 1.

Comparative Example 2

Dehydrated and dried were 40 parts by weight of the emulsion polymerization liquid 2 used in Example 2 and 144 parts by weight of the emulsion polymerization liquid used in Comparative Example 1, and 5 parts by weight of carbon black ([Printex 150T] manufactured by Degussa Japan Co., Ltd.), 1 part by weight of an azo dye ([Bontron S-34]; manufactured by Orient Chemical Ind. Co., Ltd.) and 2.5 parts by weight of wax ([Biscol 550P]; manufactured by Sanyo Kasei Ind. Co., Ltd.) were molten, kneaded, then pulverized and classified. One part by weight of hydrophobic silica was added and mixed with 100 parts by weight of the toner particles thus obtained by means of a Henschel mixer to prepare a developer for test.

The developer described above was used to carry out printing to find that though the printing density was high, the resolution was inferior and a lot of fog was produced and that the fixing strength was inferior and odor was observed to be produced. The results thereof are summarized in Table 1.

Example 5

A toner was produced in the same manner as in Example 2, except that in Example 2, the emulsion polymerization liquid 6 was substituted for the emulsion polymerization liquid 2 and the emulsion polymerization liquid 4 was substituted for the emulsion polymerization liquid 3, and printing was carried out. The results thereof are summarized in Table 1.

Example 6

Preparation of emulsion polymerization liquid 8

Polymerization was carried out in the same manner as in Example 1 to obtain an aqueous styrene base polymer dispersion, except that 0.2 part by weight of bromotrichloromethane was used in combination in polymerizing the emulsion polymerization liquid 1 in Example 1. It was analyzed to find, as a result thereof, that it had a weight average molecular weight (Mw) of 9,500, a number average molecular weight (Mn) of 4,000, a molecular weight peak (Mp) of 7,900, a gel content of 2.3% by weight and an S value of 0.00192 (equivalent/100 g of the polymer).

A toner was produced in the same manner as in Example 2, except that in Example 2, the emulsion polymerization liquid 8 was substituted for the emulsion polymerization liquid 3, and printing was carried out. The results thereof are summarized in Table 1.

TABLE 1

| | Average particle diameter of toner (μm) | Tg of toner (° C.) | Blocking property | Image density Initial | Image density After 10000 sheets | Fog Initial | Fog After 10000 sheets | Resolution (lines/mm) | Fixing on blade | Fixing strength (%) | Odor |
|---|---|---|---|---|---|---|---|---|---|---|---|
| Example 1 | 6.1 | 57.2 | Δ | 1.45 | 1.42 | 0.44 | 0.21 | 10.8 | ○ | 99.1 | ○ |
| Example 2 | 6.2 | 57.5 | ○ | 1.44 | 1.44 | 0.25 | 0.28 | 10.7 | ◎ | 96.8 | ○ |
| Example 3 | 6.2 | 56.8 | ○ | 1.47 | 1.45 | 0.28 | 0.38 | 10.8 | ◎ | 95.8 | ○ |
| Example 4 | 6.0 | 57.2 | ○ | 1.45 | 1.46 | 0.12 | 0.18 | 10.5 | ◎ | 98.2 | ○ |
| Example 5 | 6.2 | 58.0 | ○ | 1.45 | 1.45 | 0.23 | 0.29 | 10.8 | ◎ | 96.2 | ○ |
| Example 6 | 6.1 | 56.5 | ○ | 1.45 | 1.45 | 0.28 | 0.31 | 10.9 | ◎ | 99.0 | ○ |
| Comparative Example 1 | 6.0 | 56.2 | Δ | 1.46 | 1.45 | 0.99 | 0.87 | 9.5 | Δ | 92.7 | x |
| Comparative Example 2 | 7.1 | 57.5 | ○ | 1.46 | 1.49 | 1.21 | 1.32 | 8.5 | ◎ | 90.2 | x |

What is claimed is:

1. A toner for developing an electrostatic image comprising a binder resin and a colorant, wherein said binder resin comprises a low molecular weight polymer which is obtained by resin emulsion-polymerizing a mixture of two or more radical-polymerizable unsaturated monomers in the presence or absence of a chain transfer agent and in which a weight average molecular weight is 2,000 to 100,000 and falls in a range shown by the following equation:

$$3 \leqq \log Mw < 1.50 - 1.18 \times \log(S + 0.001)$$

wherein Mw represents the weight average molecular weight of the polymer, and S represents an equivalent number of a polyatomic radical part of the chain transfer agent bonded to the end of the polymer chain per 100 g of the polymer, said mixture of monomers containing 0.01 to 20% by weight of radical-polymerizable unsaturated monomer having an acidic polar group, based on the total amount of monomers in the mixture.

2. The toner as described in claim 1, wherein the low molecular weight polymer has a weight average molecular weight falling in a range shown by the following equation:

$$3.18 \leqq \log Mw > 1.24 - 1.18 \times \log(S + 0.001)$$

wherein Mw and S are synonymous with those described in claim 1.

3. The toner as described in claim 1, wherein the value of S falls in a range of 0 to 0.05.

4. The toner as described in claim 1, wherein the low molecular weight polymer is a styrene base resin or a (meth)acrylic base resin.

5. The toner as described in claim 1, wherein the low molecular weight polymer has a glass transition temperature falling in a range of 0 to 90° C.

6. The toner as described in claim 1, wherein the low molecular weight polymer has a gel content falling in a range of 0 to 50% by weight.

7. The toner as described in claim 1, wherein the binder resin further contains a high molecular weight polymer having a weight average molecular weight of larger than 100,000.

8. The toner as described in claim 7, wherein the high molecular weight polymer has a glass transition temperature falling in a range of 0 to 90° C.

9. The toner as described in claim 7, wherein the high molecular weight polymer has a gel content falling in a range of 0 to 99% by weight.

10. The toner as described in claim 7, wherein a weight ratio of the low molecular weight polymer/high molecular weight polymer falls in a range of 95/5 to 50/50.

11. A process for producing the toner as described in claim 1, comprising:

emulsion polymerizing a mixture of at least two radical-polymerizable unsaturated monomers, from 0.01 to 20% by weight, based on the total amount of monomers in the mixture, being a radical-polymerizable unsaturated monomer having an acidic polar group, at a temperature of 115° C. or higher, in the presence or absence of a chain transfer agent, to produce a low molecular weight polymer emulsified dispersion, adding a colorant to the resulting low molecular weight polymer emulsified dispersion and uniformly dispersing them, then coagulating the polymer particles together with the colorant particles to prepare a dispersion containing associated particles having a volume average particle diameter falling in a range of 1 to 15 μm, and subsequently subjecting the dispersion of said associated particles to fusion treatment and then drying it.

12. The process as described in claim 11, wherein the emulsion polymerization is carried out at a temperature of 120 to 250° C.

13. The process as described in claim 11, wherein the chain transfer agent is used in an amount of 0 to 3 parts by weight per 100 parts by weight of the unsaturated monomer.

14. A process for producing a toner according to claim 11 further comprising blending the resulting low molecular weight polymer emulsified dispersion with a high molecular weight polymer emulsified dispersion obtained by emulsion-polymerizing a radical-polymerizable unsaturated monomer in the absence of a chain transfer agent under ordinary conditions, said high molecular weight polymer having a weight average molecular weight of larger than 100,000.

15. The process as set forth in claim 14, wherein the step of adding colorant comprises adding colorant directly to the blend of the as produced low molecular weight polymer emulsified dispersion and the high molecular weight polymer emulsified dispersion.

16. A process for producing a toner according to claim 11, wherein the step of emulsion-polymerizing a mixture of radical-polymerizable unsaturated monomers at a temperature of 115° C. or higher to form said low molecular weight polymer emulsified dispersion is carried out in the substantial absence of a chain transfer agent, said step further comprising, lowering the temperature to 100° C. or lower and, suitably supplementing radical-polymerizable unsaturated monomer and/or adding polymerization initiator and allowing emulsion polymerization to proceed until there is formed a high molecular weight polymer having a weight average molecular weight of larger than 100,000, whereby the resulting binder comprises composite polymer particles comprising both the said low molecular weight polymer and the said high molecular weight polymer.

17. The process as set forth in claim 16, wherein the step of adding colorant comprises added colorant directly to the as produced emulsion containing said composite polymer particles.

18. A process for producing a toner according to claim 11, further comprising emulsion-polymerizing radical-polymerizable unsaturated monomer at a temperature of 100° C. or lower, substantially in the absence of chain transfer agent to form a high molecular weight polymer emulsified dispersion, said high molecular weight polymer having a weight average molecular weight of larger than 100,000, elevating the temperature to 115° C. or higher, and suitably supplementing radical-polymerizable unsaturated monomer and/or adding polymerization initiator and allowing emulsion polymerization to proceed until there is formed said low molecular weight polymer, whereby the resulting binder comprises composite polymer particles comprising both the said low molecular weight polymer and the said high molecular weight polymer.

19. The process as set forth in claim 18, wherein the step of adding colorant comprises adding colorant directly to the as produced emulsion containing said composite polymer particles.

20. The process as set forth in claim 11, wherein the step of adding colorant comprises adding colorant directly to the as produced low molecular weight polymer emulsified dispersion.

21. The process as set forth in claim 11, wherein the acidic polar group is a carboxyl group, a sulfone group, a phosphoric acid group or a formyl group.

22. The process as set forth in claim 11, wherein the acidic polar group is a carboxyl group.

23. The process as set forth in claim 11, wherein the low molecular weight emulsified polymer dispersion resulting from said step of emulsion polymerizing comprises said low molecular weight polymer having a particle diameter falling in a range of from 0.01 to 2 $\mu$m.

24. The process as set forth in claim 11, wherein the low molecular weight emulsified polymer dispersion resulting from said step of emulsion polymerizing comprises said low molecular weight polymer having a particle diameter falling in a range of from 0.02 to 1 $\mu$m.

25. The toner as set forth in claim 1, wherein the acidic polar group is a carboxyl group, a sulfone group, a phosphoric acid group or a formyl group.

26. The toner as set forth in claim 1, wherein the acidic polar group is a carboxyl group.

27. The toner as set forth in claim 1, wherein said binder resin and colorant are present in the form of associated particles having a volume-average particle diameter in a range of from 1 to 15 $\mu$m.

28. The toner as set forth in claim 27, wherein said associated particles are substantially spherical.

29. The toner as set forth in claim 1, wherein said binder resin and colorant are present in the form of associated particles having a volume-average particle diameter in a range of from 3 to 10 $\mu$tm.

30. The toner as set forth in claim 29, wherein said associated particles are substantially spherical.

* * * * *